US006766530B2

(12) United States Patent
Grilliot et al.

(10) Patent No.: US 6,766,530 B2
(45) Date of Patent: Jul. 27, 2004

(54) FACE MASK, FITMENT, HEAD HARNESS, AND PROTECTIVE HOOD FOR FIREFIGHTER

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/405,514

(22) Filed: Apr. 2, 2003

(65) Prior Publication Data

US 2004/0064866 A1 Apr. 8, 2004

Related U.S. Application Data

(63) Continuation-in-part of application No. 10/265,863, filed on Oct. 7, 2002, now Pat. No. 6,691,314.

(51) Int. Cl.[7] ..... A62B 1/00

(52) U.S. Cl. ..... 2/9; 2/5; 2/205; 2/424; 128/201.23; 128/201.29

(58) Field of Search ..... 2/5, 9, 173, 202, 2/205, 424, 6.2, 6.3; 128/201.25, 201.29, 201.24, 201.22, 202.11, 201.23, 205.25

(56) References Cited

U.S. PATENT DOCUMENTS 1,930,399 A * 10/1933 Hermann ..... 128/201.23
2,156,852 A * 5/1939 Vaclav ..... 128/205.27
2,390,233 A * 12/1945 Akerman ..... 128/202.11
2,435,167 A * 1/1948 Stetson ..... 128/201.23
4,573,217 A 3/1986 Reed
4,848,330 A * 7/1989 Cowles ..... 128/200.24
4,972,520 A 11/1990 Grilliot et al.
4,975,980 A * 12/1990 Ersteniuk ..... 2/5
6,006,360 A 12/1999 Reed
6,266,828 B1 7/2001 Corsini
6,328,031 B1 12/2001 Tischer et al.
6,478,025 B1 11/2002 Yort et al.
6,520,177 B1 * 2/2003 Bonhomme et al. ... 128/201.28
6,578,572 B2 6/2003 Tischer et al.

* cited by examiner

*Primary Examiner*—Rodney M. Lindsey
(74) *Attorney, Agent, or Firm*—Wood, Phillips, Katz, Clark & Mortimer

(57) ABSTRACT

For a firefighter, rescue worker, or chemical worker or another wearer needing head protection, a protective hood, a fitment, a face mask, and a head harness are combined. The protective hood is adapted to cover the wearer's head, except for a frontal region of the wearer's head. The fitment is attached to the protective hood so as to situate the fitment below the frontal region of the wearer's head. The head harness is attached to the face mask so as to secure the face mask to the wearer's head, over the frontal region of the wearer's head. The fitment is attached detachably to the protective hood and to the face mask. In a preferred embodiment, the fitment is a regulator of a self-contained breathing apparatus. In an alternative embodiment, the fitment is a respirator, to which an air filter is attached.

6 Claims, 1 Drawing Sheet

FACE MASK, FITMENT, HEAD HARNESS, AND PROTECTIVE HOOD FOR FIREFIGHTER

CROSS-REFERENCE TO RELATED APPLICATION

This invention is a continuation-in-part of U.S. patent application Ser. No. 10/265,863, which was filed on Oct. 7, 2002 now U.S. Pat. No. 6,691,314, and the disclosure of which application is incorporated herein by reference.

TECHNICAL FIELD OF THE INVENTION

This invention pertains generally to protective gear for a firefighter, rescue worker, or chemical worker or another wearer needing head protection and respiratory assistance. This invention pertains particularly to a face mask, a fitment, as discussed below, a head harness, and a protective hood, in a novel combination.

BACKGROUND OF THE INVENTION

Commonly, a firefighter, rescue worker, or chemical worker or another wearer needing respiratory and head protection is required to wear a face mask secured removably to the wearer's head, via a head harness, which is attached detachably to the face mask, via fasteners at or near an outer perimeter of the face mask. Commonly, a fitment is secured removably to the face mask. The fitment may be an element of a self-contained breathing apparatus, such as a regulator, or the fitment may be a respirator, to which an air filter is mounted.

Along with the face mask, the firefighter may be also required to wear a protective hood, which provides a fire-retardant, thermally insulative barrier protecting the wearer's head, except for at least a portion of the wearer's face where the face mask is worn, and protecting the wearer's neck, and which is worn over the head harness and over at least part of an outer perimeter of a window portion of the face mask. As exemplified in U.S. Pat. No. 6,266,828, U.S. Pat. No. 6,328,031, and U.S. Pat. No. 6,478,025, the disclosures of which patents are incorporated herein by reference, it is known for the protective hood to be detachably attached to the face mask.

SUMMARY OF THE INVENTION

For a firefighter, rescue worker, or chemical worker or another wearer needing head protection, this invention provides a face mask, a fitment, a head harness, and a protective hood, in a novel combination. The protective hood is adapted to cover the wearer's head, except for a frontal region of the wearer's head, when the protective hood is worn. The fitment is attached to the protective hood so as to situate the fitment below the frontal region of the wearer's head, when the protective hood is worn. The head harness is attached to the face mask so as to secure the face mask to the wearer's head, over the frontal region of the wearer's head, when the face mask and the head harness are worn. The fitment is attached to the face mask.

Preferably, the fitment is attached detachably to the face mask so that a wearer can remove the face mask and the head harness, after detaching the fitment from the face mask, without having to detach the fitment from the protective hood. Preferably, the protective hood is not attached to the face mask or to the head harness, except via the fitment, as attached to the face mask.

Furthermore, this invention provides a novel method of preparing and donning a protective hood, a fitment, a face mask, and a head harness. As preliminary steps, the novel method comprises attaching the head harness to the face mask, attaching the fitment to the protective hood so as to situate the fitment below a frontal region of the wearer's head, when the protective hood is worn, and attaching the fitment to the face mask. As subsequent steps, the novel method comprises donning the face mask and the head harness so as to secure the face mask to the wearer's head and, thereupon, donning the protective hood so as to cover the wearer's head, except for the frontal region of the wearer's head.

BRIEF DESCRIPTION OF THE DRAWINGS

FIG. 1 also illustrates a screw and an associated washer, which are used to attach the fitment to the protective hood, via a gasketed hole in the protective hood.

DETAILED DESCRIPTION OF THE ILLUSTRATED EMBODIMENT

Figure 1:
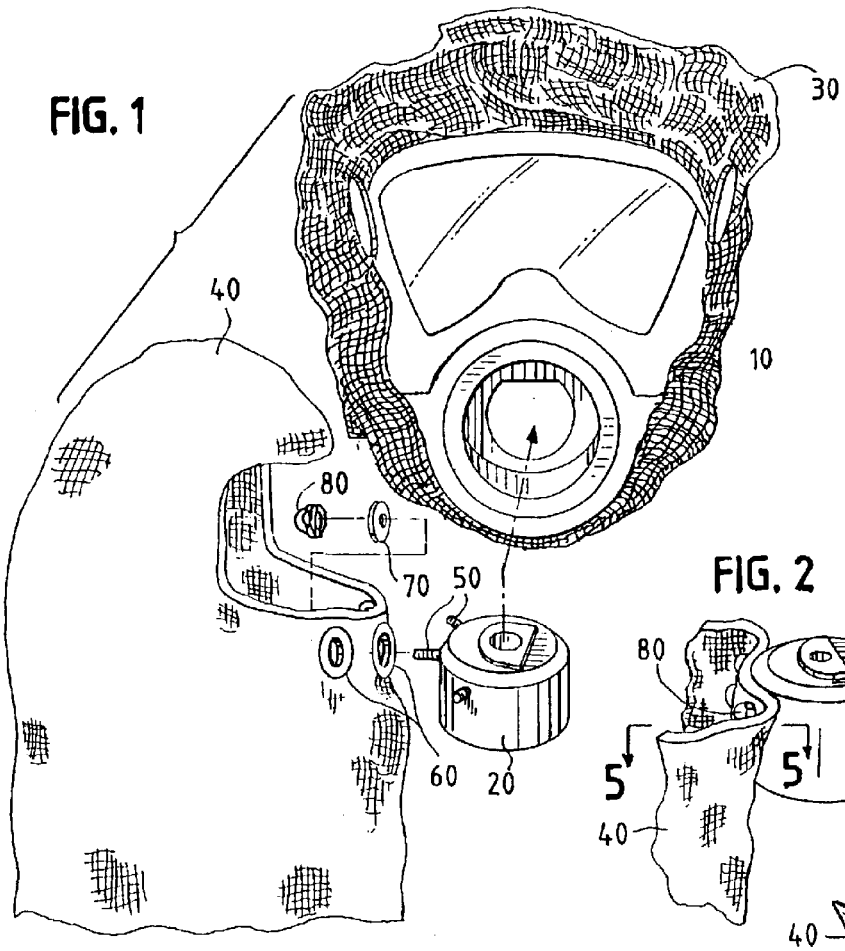
FIG. 1 is an exploded, perspective view of a face mask, a fitment, a head harness, and a protective hood, in a novel combination embodying this invention.
Figure 2:
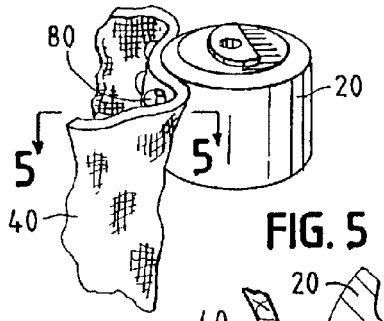
FIG. 2, on a larger scale compared to FIG. 1, is a fragmentary, perspective view of the face mask, the fitment, as attached detachably to the face mask, and the protective hood, to which the fitment is attached.
Figure 5:
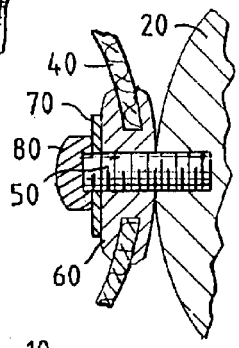
FIG. 5, on a larger scale compared to FIGS. 3 and 4, is a fragmentary, sectional view, as taken along line 5—5 of FIG. 4, in a direction indicated by arrows.

As illustrated, this invention provides a face mask 10, a fitment 20, a head harness 30, and a protective hood 40, in a novel combination, for a firefighter, rescue worker, or chemical worker or another wearer needing head protection and respiratory assiatance.

Except as illustrated and described herein, the face mask 10 may conform to the face mask disclosed in U.S. patent application Ser. No. 10/265,863, supra, to the face mask disclosed in U.S. Pat. No. 6,266,828, supra, or to the face mask disclosed in U.S. Pat. No. 6,328,031, supra. Except as illustrated and described herein, the head harness 30 may conform to the head harness disclosed in U.S. patent application Ser. No. 10/265,863, supra, or to the head harness disclosed in U.S. Pat. No. 6,328,031, supra.

In a preferred embodiment, the fitment 20 is a regulator, which is attachable to an air hose of a self-contained breathing apparatus, of which the regulator is an element. In an alternative embodiment, the fitment 20 is a respirator, to which an air filter (not shown) is mounted. Details of such a regulator, details of other elements of such a breathing apparatus, details of such a respirator, and details of such an air filter are outside the scope of this invention and can be readily supplied by persons having ordinary skill in the relevant art.

Except as illustrated and described herein, the protective hood 40 may conform to the protective hood disclosed in U.S. Pat. No. 4,972,520, the disclosure of which patent is incorporated herein by reference, or to other protective hoods sold commercially, heretofore, by Morning Pride Manufacturing, L.L.C. of Dayton, Ohio. The protective hood 40 is adapted to cover the wearer's head, except for a frontal region of the wearer's head, when the protective hood 40 is worn.

Any suitable means may be used to attach the fitment 20 to the protective hood 40. As illustrated, the fitment 20 is attached to the protective hood 40 via screws 50, which are threaded into and project from threaded sockets in the fitment 20. Each screw 50 passes through a gasket 60 protecting a hole in the protective hood 40 and through a washer 70 and receives a cap nut 80. The fitment 20 is attached to the protective hood 40, as illustrated and described or in any other suitable manner, so as to situate the fitment 20 below the frontal region of the wearer's head, when the protective hood 40 is worn.

The head harness 30 is attached to the face mask 10, in a known manner, so as to secure the face mask 10 to the wearer's head, over the frontal region of the wearer's head, when the face mask 10 and the head harness 30 are worn. The fitment 20 is attached detachably to the face mask 10, as via a bayonet connection requiring a quarter turn of the face mask 10 relative to the fitment 20 or a quarter turn of the fitment 20 relative to the face mask 10, either to attach the fitment 20 to the face mask 10 or to detach the fitment 20 from the face mask 10.

Figure 3:
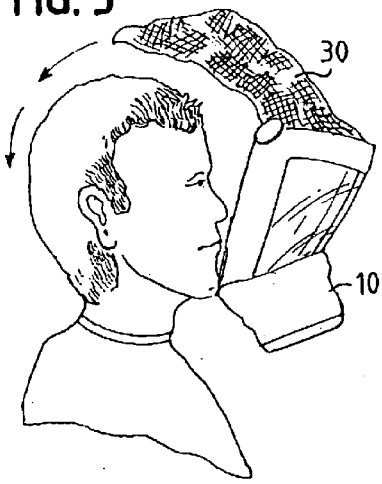
FIGS. 3 and 4, on a smaller scale compared to FIG. 1, are fragmentary, perspective views illustrating a wearer, respectively, while the wearer is donning the novel combination and after the wearer has donned the novel combination.
Figure 4:
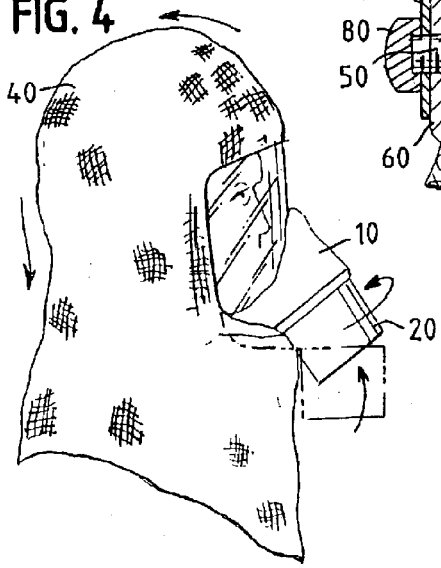

As illustrated in FIGS. 3 and 4, the face mask 10, the fitment 20, the head harness 30, and the protective hood 40 are prepared by preliminary steps of attaching the head harness 30 to the face mask 10, in a known manner, attaching the fitment 20 to the protective hood 40, as described above, and attaching the fitment 20 to the face mask 10, as described above. Desirably, these preliminary steps are performed before a firefighter, rescue worker, or chemical worker or another wearer needing head protection is called to a tactical situation.

As in a tactical situation, the face mask 10, the fitment 20, the head harness 30, and the protective hood 40 can be then donned by subsequent steps of donning the face mask 10 and the head harness 30 so as to secure the face mask to the wearer's head and, thereupon, donning the protective hood 40 so as to cover the wearer's head, except for the frontal region of the wearer's head. Because the fitment 20 is attached detachably to the face mask 10, a wearer can remove the protective hood 40, after detaching the fitment 20 from the face mask 10, without having to detach the fitment 20 from the protective hood 40.

What is claimed is:

1. For a firefighter, rescue worker, or chemical worker or another wearer needing head protection, a combination comprising a protective hood, a fitment, a face mask, and a head harness, wherein the protective hood is adapted to cover the wearer's head, except for a frontal region of the wearer's head, when the protective hood is worn, wherein the fitment is attached to the protective hood so as to situate the fitment below the frontal region of the wearer's head, when the protective hood is worn, wherein the head harness is attached to the face mask so as to secure the face mask to the wearer's head, when the face mask and the head harness are worn, and wherein the fitment is attached to the face mask.

2. The combination of claim 1 wherein the fitment is attached detachably to the face mask so that a wearer can remove the protective hood, after detaching the fitment from the face mask, without having to detach the fitment from the protective hood.

3. The combination of claim 1 wherein the protective hood is not attached to the face mask or to the head harness, except via the fitment, as attached to the face mask.

4. The combination of claim 3 wherein the fitment is attached detachably to the face mask so that a wearer can the remove protective hood, after detaching the fitment from the face mask, without having to detach the fitment from the protective hood.

5. For a firefighter, rescue worker, or chemical worker or another wearer needing head protection, a method of preparing and donning a protective hood, a fitment, a face mask, and a head harness, the method comprising preliminary steps of attaching the head harness to the face mask and attaching the fitment to the protective hood so as to situate the fitment below the frontal region of the wearer's head, when the protective hood is worn, the method comprising subsequent steps of donning the face mask and the head harness so as to secure the face mask to the wearer's head and, donning the protective hood so as to cover the wearer's head, except for a frontal region of the wearer's head and thereupon attaching the fitment to the face mask.

6. The method of claim 5 wherein the step of attaching the fitment to the face mask comprises attaching the fitment detachably to the face mask so that a wearer can remove the protective hood, after detaching the fitment from the face mask, without having to detach the fitment from the protective hood.

* * * * *